United States Patent [19]

Powers

[11] Patent Number: 4,976,088

[45] Date of Patent: Dec. 11, 1990

[54] METHOD FOR CONSTRUCTION OF AN IN-GROUND SWIMMING POOL

[76] Inventor: John W. Powers, Rte. 3, Box 403A, Nevada, Mo. 64772

[21] Appl. No.: 306,478

[22] Filed: Feb. 3, 1989

[51] Int. Cl.[5] ..... E04B 1/00; E04G 21/10; E02D 17/00

[52] U.S. Cl. ..... 52/742; 52/743; 52/169.7; 52/169.8

[58] Field of Search ..... 52/743, 169.7, 169.8, 52/102

[56] References Cited

U.S. PATENT DOCUMENTS

| | | | |
|---|---|---|---|
| 3,192,538 | 7/1965 | Walter | 52/169.8 |
| 3,511,002 | 5/1970 | Fox | 52/169.8 |
| 4,548,005 | 10/1985 | Glonek et al. | 52/169.8 |
| 4,818,142 | 4/1989 | Cochran | 52/169.7 |

FOREIGN PATENT DOCUMENTS

| | | | |
|---|---|---|---|
| 1544932 | 9/1968 | France | 52/169.8 |
| 2416991 | 10/1979 | France | 52/169.8 |

*Primary Examiner*—Richard E. Chilcot, Jr.
*Assistant Examiner*—Deborah McGann Ripley
*Attorney, Agent, or Firm*—Litman, McMahon & Brown

[57] ABSTRACT

A method for construction of an in-ground swimming pool includes the steps of excavating a hole with a wall, providing a shelf associated with the wall and installing a footing form structure with a form member in association with the shelf. The footing form member is leveled and a concrete footing is poured in a footing form volume defined by the wall, the shelf and the form member. Wall form panels are placed on the footing and a concrete wall is poured therebetween.

3 Claims, 2 Drawing Sheets

METHOD FOR CONSTRUCTION OF AN IN-GROUND SWIMMING POOL

BACKGROUND OF THE INVENTION

This invention relates generally to construction and in particular to a method and apparatus for construction of in-ground swimming pools having vinyl liners.

Conventional in-ground swimming pool construction often begins by marking, e.g. with chalk lines or stakes, a ground surface with the general outline or layout of the necessary excavation. The dimensions and shape of the excavation are generally determined by the desired pool surface area plus a perimeter area for construction of the pool walls. Excavation can then be accomplished by digging a hole having a desired shape and depth within the marked area. The excavation can include a shelf having a uniform width at the outer periphery of the swimming pool hole. The shelf is normally intended to be generally horizontal and can be positioned at a depth of about three feet vertically beneath the ground surface. The shelf, therefore, generally conforms to the shape of the pool and is provided for the support of wall-forming falsework comprising standard height wall forms used to form concrete pool walls for vinyl liner pools.

The assembled falsework can comprise an inboard wall in uniform spaced relationship to an outboard wall. Both the inboard wall and the outboard wall can be constructed from numerous individual panels. The individual panels can be sized sufficiently small to facilitate transportation to and from a work site, and for ease of assembly and disassembly. The individual panels forming the inboard and outboard walls of the falsework are normally all of uniform height. Various shapes and sizes of wall form panels can be provided so that, when assembled, the falsework generally conforms to the pool layout as marked prior to excavation.

Once the wall forms are assembled on the shelf, they usually require adjustment so that an upper edge of the assembled falsework is horizontal. Such an adjustment is often necessary because the work shelf supporting the falsework or form assembly is usually not uniformly horizontal, as excavated. If an upper edge of one portion of a falsework assembly is lower than another portion, freshly poured cement may spill over the upper edge of the lower portion of the falsework when the falsework assembly is filled with semi-liquid concrete. Thus, prior to pouring concrete, the upper edge of the falsework assembly should be uniformly horizontal.

Thus, to provide a uniformly horizontal upper edge of the falsework assembly, the work shelf on which the false-work assembly is positioned must be uniformly horizontal or adjustments are required. In the past, problems have been encountered in excavating a work shelf which is horizontally true. The problems associated with excavating the horizontal shelf are pronounced when the excavation site is located on a sloping grade. Further, since the shelf cannot be practicably made uniformly horizontal, vertical adjustments in the falsework assembly are called for. When adjustments in the falsework assembly are required, problems are encountered in making vertical and horizontal adjustments because of the massive and unwieldy nature of the assembled falsework.

The problems are worsened when the swimming pool is built onto a surface which is sloping because of the difficulty in excavating a horizontal shelf.

To date, no art to the applicant's knowledge has been directed to a method of building in in-ground swimming pools having vinyl liners which substantially eliminates the need to vertically or horizontally adjust assembled falsework prior to filling with concrete. Falsework structures have been proposed which incorporate panels designed with stake leveling devices. However, because such devices significantly increase the cost of the installation, such devices are not totally satisfactory.

SUMMARY OF THE INVENTION

The present invention provides a method for constructing in-ground swimming pools having vinyl liners which substantially eliminates a need to vertically and horizontally align swimming pool falsework assemblies prior to pouring concrete. In particular, a shelf is excavated at a depth slightly greater than the depth of a conventional working shelf. A footing form is constructed and positioned at an interior edge of the footing shelf. The footing form is constructed from any suitable material, including wood or metal. Cross members which span the excavated swimming pool hole are fixedly attached to an inboard vertical face and are provided to give the footing form structural rigidity.

Compared to the difficulty in adjusting assembled falsework, the footing form of the present invention is relatively easy to adjust because the form is constructed of relatively lightweight material and also because it is substantially rigid. Once adjusted, the footing form is braced to prevent vertical and horizontal movement. Once the footing form is positioned, a footing volume is thus defined by an outboard vertical face of the footing form, by a vertical earth wall adjacent an outboard edge of the shelf, and by the shelf surface. A concrete footing is formed by pouring semi-liquid, viscous concrete into the footing volume. An upper surface of the concrete poured into the footing volume is leveled and made flush with an upper edge of the footing form. The concrete is allowed to set up over a period of time. Thereafter, a substantially level and solid concrete footing is provided on which to assemble concrete falsework in such a manner as to substantially eliminate the need for vertical and horizontal adjustment prior to filling with concrete.

OBJECTS OF THE INVENTION

The principal objects of the present invention are: to provide a method disclosing a footing form structure for use in the construction of in-ground swimming pools incorporating vinyl liners; to provide a method disclosing such a form structure which substantially reduces the need to vertically and horizontally adjust assembled falsework forms prior to filling with concrete; to provide a method disclosing such a structure which can be used during the construction of generally any in-ground swimming pool incorporating standard height pool walls; to provide a method disclosing such a structure which substantially reduces the cost of construction of an in-ground swimming pool; and to provide such a structure which is economical to manufacture, safe and effective during construction, and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute part of this specification, including exemplary embodiments of the present invention, and illustrate various objects and features thereof.

DETAILED DESCRIPTION OF THE PREFERRED EMBODIMENT

Figure 1:
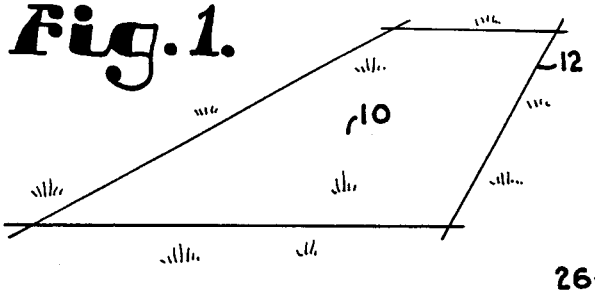
FIG. 1 is a perspective view of a swimming pool hole excavation site.
Figure 2:
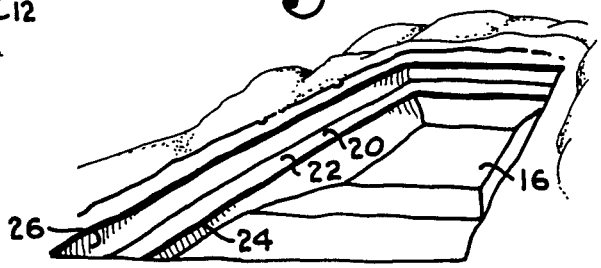
FIG. 2 is a perspective view of a swimming pool hole excavated into the excavation site.
Figure 3:
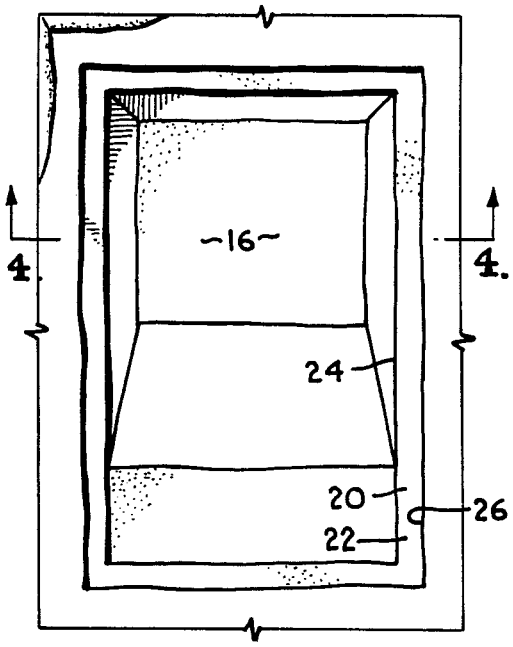
FIG. 3 is a top plan view of the excavated swimming pool hole showing a work shelf excavated at the outer periphery of the swimming pool hole.
Figure 4:
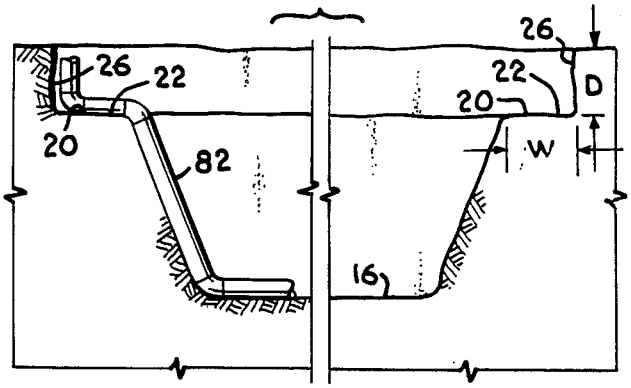
FIG. 4 is an enlarged, vertical, cross-sectional view of the excavated swimming pool hole taken generally along line 4–4 in FIG. 3, showing the work shelf excavated along the outer periphery of the swimming pool hole.
Figure 5:
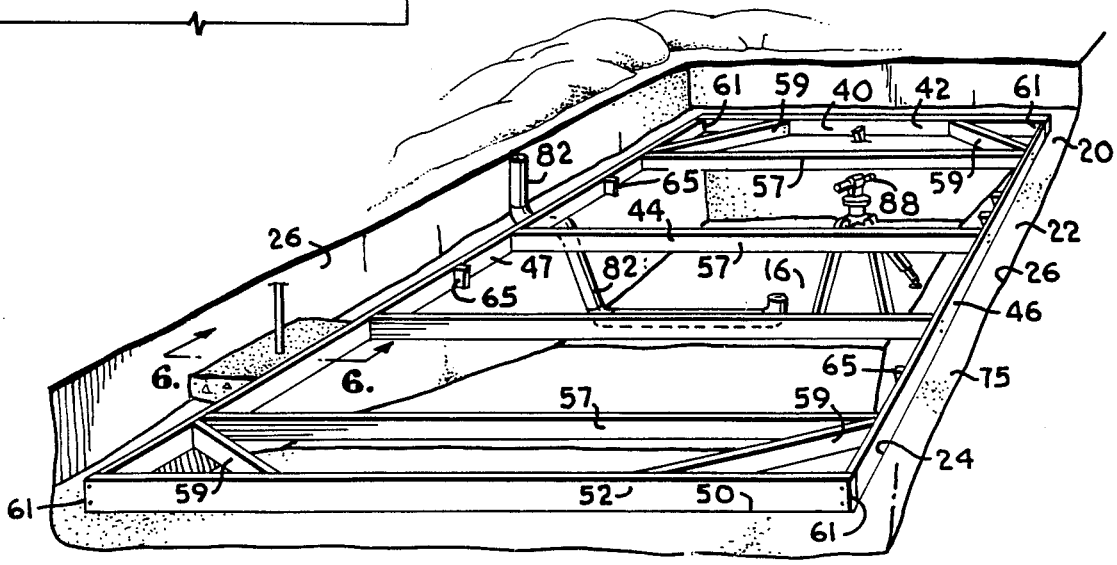
FIG. 5 is a perspective view of the excavated swimming pool hole showing a footing form structure mounted on and staked to an interior edge of the shelf.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

I. Introduction and Environment

The reference numeral 10 generally designates a swimming pool excavation site. A mark, e.g. a chalk line, 12 is placed on the excavation site 10 to generally identify the desired surface shape and dimensions of an in-ground swimming pool 14. A hole 16 is excavated within the mark 12 in an earthen ground mass 13. The hole 16 is excavated to accommodate the swimming pool 14 and also to accommodate a work shelf 20.

The work shelf 20 is excavated in an outboard, peripheral wall 26 of the hole 16 and is of generally endless configuration. In the preferred embodiment, the work shelf 20 located at a depth (D) of approximately 36″. The width (W) of the shelf 20 in the preferred embodiment is about 24″. The shelf 20 is excavated as horizontally as possible. The shelf 20 is defined by a horizontal surface 22, an interior edge 24 and the outboard wall 26 of the hole 16.

II. Footing Form Structure 40

A footing form structure or falsework 40 comprises a footing form 42 and a support structure 44. The footing form 42 comprises an outboard vertical face 46, an inboard vertical face 47, a ground engaging lower edge 50, and an upper edge 52. The outboard vertical face 46 is generally vertical and has a generally endless configuration which aligns with the interior edge 24 of the work shelf 22. The height (H) of the footing form 42 in the preferred embodiment is about five and one-half inches.

The support structure 44 is provided to support the outboard vertical face 46 of footing form 42 generally in its vertical position. The support structure 44 comprises a plurality of cross members 57 and corner diagonal members 59. The cross members 57 are in parallel, spaced relation and are fixedly attached to the inboard vertical face 47 of the footing form 42. A sufficient number of cross members 57 are provided to maintain the vertical alignment of the footing form 42. The diagonal members 59 are fixedly attached to the inboard vertical surface 47 at each of four corners 61 of the footing form 42. The diagonal members 59 are provided to give the footing form structure 40 additional rigidity.

Figure 6:
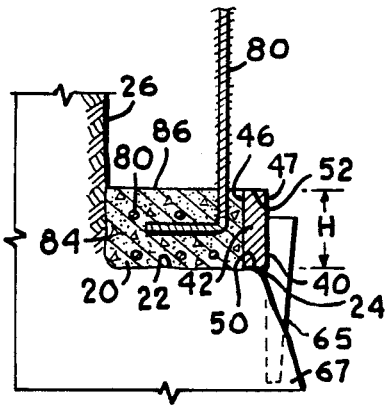
FIG. 6 is an enlarged, fragmentary, vertical cross-sectional view of a footing volume filled with semi-liquid, viscous concrete in which reinforcing bars are shown and taken generally along line 6—6 in FIG. 5.
Figure 7:
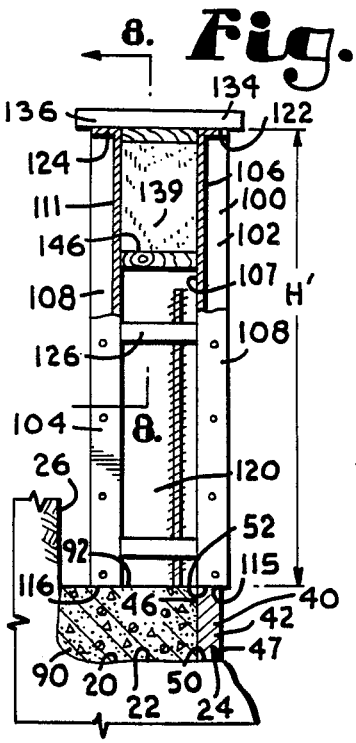
FIG. 7 is an enlarged, fragmentary, cross-sectional view of a concrete footing on which is positioned a falsework assembly having a skimmer box structure positioned therein, taken generally along line 7—7 in FIG. 9 and showing the falsework assembly prior to filling with concrete.
Figure 8:
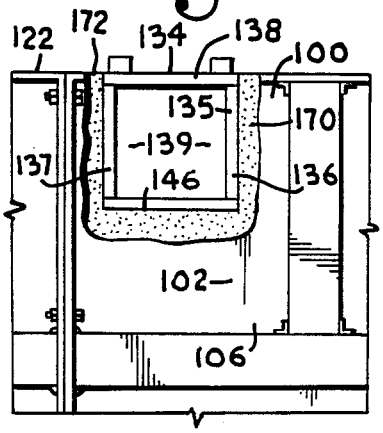
FIG. 8 is an enlarged, fragmentary, front elevational view of a falsework assembly filled with concrete, showing the skimmer box structure positioned between the wall forms and fresh cement.
Figure 9:
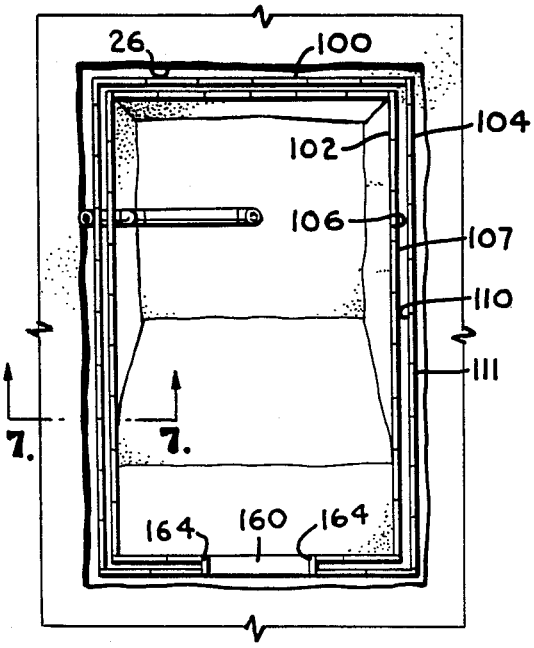
FIG. 9 is a top plan view of the excavated swimming pool hole showing the assembled falsework positioned on the concrete footing and also showing a step volume blocked out of the falsework for a pool having steps.
Figure 11:
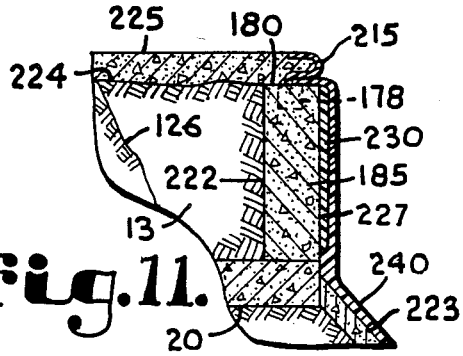
FIG. 11 is an enlarged, fragmentary, vertical cross-sectional view of the concrete footing, the pool wall, a deck and a coping taken generally along like 11—11 in FIG. 10.
Figure 10:
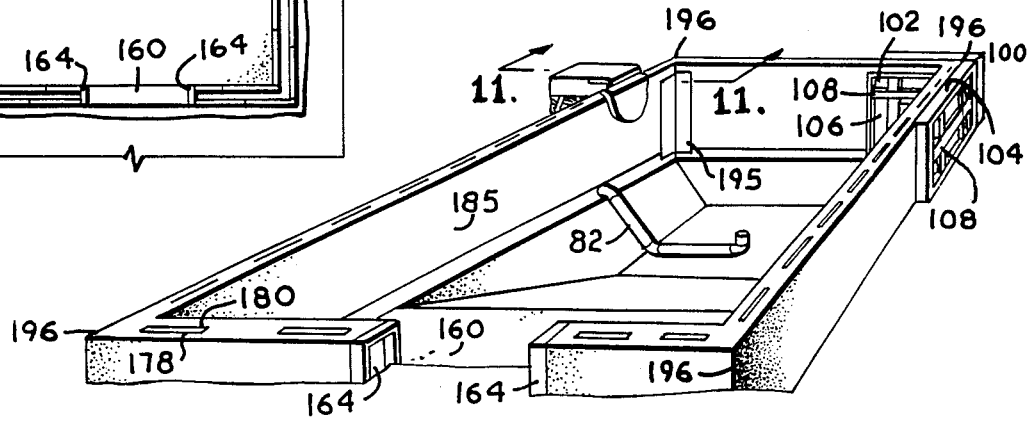
FIG. 10 is a perspective view of the swimming pool wall with the falsework assembly partially removed and showing a step volume for pool steps.

The footing form structure 40 is horizontally positioned in the hole 16 such that the outboard vertical face 46 is in general vertical alignment with the interior edge 24 of the work shelf 20. The footing form structure 40 is held in its position by a plurality of stakes 65 wedged into a subsurface 67 of the hole 16, as shown in FIG. 6 in phatom. The stakes 65 are inserted into the subsurface 67 of hole 16 at locations adjacent to the inboard vertical surface 47 whereby the stakes 65 bias against the inboard vertical surface 47.

Once the footing form structure 40 is in its secured horizontal position, vertical leveling adjustments are made such that a plane defined by the upper edge 52 of the footing form 42 is substantially horizontal. Vertical leveling adjustments can be made using any conventional means of measurement, including a conventional carpenter's level or a transit 88 positioned on any available surface including the upper edge 52 of the footing form structure 40. Such a level can be used to check reference points of the footing form structure 40.

III. Concrete Footing 90

After the footing form structure 40 is both horizontally and vertically aligned, a horizontal footing form volume 75 is created and defined by the outboard vertical face 46 of the footing form 42, the horizontal surface 22 of the shelf 20, and the outboard wall 26 of the shelf 20.

A lattice of horizontal reinforcing bars 80 is inserted into the footing form volume 75 to provide structural stability prior to pouring any concrete. Any conventional plumbing which must pass through or beneath the footing volume 75, such as a drain pipe 82, should be positioned at the appropriate location in the footing volume 75.

The footing form volume 75 is filled with semi-liquid or viscous concrete 84 and an upper horizontal surface 86 of the concrete 84 is made generally horizontal and level by conventional leveling methods using the upper horizontal edge 52 of the footing form structure 40 as a guide. A concrete footing 90 is created after the concrete 84 sets up. The concrete footing 90 is generally horizontal. The horizontal footing 90 has a shape substantially identical to the footing form volume 75 with an upper surface 92 of the horizontal footing 90 being substantially identical to the upper surface 86 created in the fresh concrete 84 prior to the setting up of the fresh concrete 84.

IV. Assembling Wall Forms

The footing upper surface 92 provides a substantially horizontal surface on which to place a wall form structure 100. The wall form structure 100 comprises an interior wall 102 of endless configuration and an exterior wall 104 of endless configuration. The interior wall 102 has an inboard face 106 and an outboard face 107. The exterior wall 104 has an inboard face 110 and an outboard face 111. In the preferred configuration, the outboard face 107 of the interior wall 102 is in vertical alignment with the outboard vertical face 46 of the footing form 42. The inboard face 110 of the exterior wall 104 is in relatively uniform, parallel, spaced relationship from the outboard face 107 of the interior wall 102. The outboard face 107 of the interior wall 102 and the inboard face 110 of the exterior wall 104 are of generally smooth and endless configuration. The inboard face 106 of the interior wall 102 and the outboard face 111 of the exterior wall 104 are provided with a conventional reinforcing framework 108 for stability.

A bottom edge 115 of the interior wall 102 is positioned on and supported by the upper horizontal surface 52 of the footing form structure 40. A bottom edge 116 of the exterior wall 104 is positioned on and supported by the upper surface 92 of the horizontal footing 90. The interior wall 102 and the exterior wall 104, in the preferred embodiment, have a height (H') of about 36".

A wall volume 120 is defined by outboard face 107 of the interior wall 102, the inboard face 110 of the exterior wall 104 and the upper surface 92 of the horizontal footing 90 lying between the inboard face 106 and the outboard face 110. A plane defined by an upper edge 122 of the interior wall 102 and the upper edge 124 of the exterior wall 104 will be substantially horizontal since the wall form structure 100 was positioned on the substantially horizontal upper surface 92 of the horizontal footing 90. As such, generally no vertical adjustment is required in the wall form structure 100. Further, since the outboard face 107 of the interior wall 102 is aligned with the outboard vertical surface 46 of the footing form 40, generally no horizontal alignments are necessary.

The relatively parallel spacing (e.g. about eight-inches) between the interior wall 102 and the exterior wall 104 can be maintained by conventional methods such as by releasably attaching wall ties 126 at a plurality of locations throughout the wall form structure 100.

A skimmer box form structure 134 comprises a frame 135 in the shape of a box, which in the preferred embodiment has a height of ten and one-half inches, a width of twelve inches and a depth of eight inches. The frame 135 is constructed of any suitable material, including lumber. The form structure 134 is positioned in the wall form structure 100 to create a skimmer volume 139. The skimmer volume 139 is defined by an interior 146 of the frame structure 134 and also by portions of the interior wall 102 and the exterior wall 104. The frame 135 includes a first vertical member 136 and a second vertical member 137. An upper horizontal member 138 of the skimmer form frame 135 is positioned flush with the upper edges 122 and 124 of the wall structure 100. The skimmer form structure 135 is preferably positioned in the wall form structure 100 such that neither the first vertical surface 136 nor the second vertical surface 137 is nearer than 3 feet to any corner 61.

Return fitting conduits 150 are constructed of about $2\frac{1}{2}$ inch internal diameter thin wall plastic pipe sections each approximately 8" long. Return fitting conduits 150 are transversely positioned within the wall frame structure 100. The conduits 150 are provided to accommodate any conventional pool plumbing.

A step volume 160 is formed in the wall form structure 100 if steps are to be installed. The step volume 160 is formed by installing studs 164 in the wall form structure 100 to enclose wall form ends 166 on both sides of the steps 162. The studs 164 are spaced far enough apart to accommodate the width of the steps to be installed. Steps may then be anchored to the studs 164 using lag bolts.

V. Swimming Pool Wall 185

Semi-liquid or viscous concrete 170 is poured into the wall form structure 100 such that the wall volume 120 is completely filled. An upper edge 172 of the concrete 170 is made flush with the upper edges 122 and 124 of the wall form structure 100.

A plurality of wood blocks comprising nailers 178 with upper horizontal faces 180 are installed with the nailer uppr faces 180 substantially flush with the upper edge 172 of the fresh concrete 170. The wood blocks 180 are positioned with about one inch between the outboard face 107 of the interior form wall 102 and the nearest vertical surface 182 of the wood block 178. A plurality of wood blocks 178 are spaced about every 16" cross the entire upper surface 172 of the fresh concrete. The fresh concrete 170 is allowed to set up and cure in the wall form structure 100.

The wall form structure 100, the footing form structure 40, and the skimmer form frame 136 are stripped or removed leaving a swimming pool wall 185.

VI. Construction of Pool completed with conventional parts and methods

Conventional plumbing 187 is provided at appropriate locations in the wall 185. A skimmer plate 190 and a skimmer 193, e.g. a Hayward SP-1084-1, of conventional design are installed by conventional methods in the skimmer volume 145.

Corner members 195 are installed by conventional methods to each of four corners 196 of the swimming pool wall 185. A coping 215 of conventional design is installed on the upper surface 172 of the swimming pool wall 185 by fixedly attaching the coping 215 to the upper horizontal faces 180 of the wood blocks 178 set in the swimming pool wall 185. A space comprising the volume between the outboard wall surface 222 and the outboard wall 126 of the work shelf 20 is backfilled to create a finished grade surface 224 substantially flush with the upper horizontal surface 180 of the swimming pool wall 185. A conventional deck 225 is constructed over the surface 224 and the swimming pool wall 185.

An interior vertical face 227 of the swimming pool wall 185 is lined using conventional adhesives with roll foam 230. A vermiculite and Portland cement surface 233 with a desired depth is applied by conventional methods to that portion (i.e. the hopper) of the hole 16 which lies beneath the shelf surface and about one and one-half inches up the footing 90. A conventional liner 240 is installed by conventional methods and is fixedly attached to the coping 215. Other miscellaneous tasks may be undertaken to complete the in-ground pool.

It is to be understood that while certain forms of the present invention have been illustrated and described herein, it is not to be limited to specific forms or arrangements of parts described and shown.

What is claimed and desired to be secured by Letters Patent is as follows:

1. An in-ground swimming pool construction method in an excavated hole with an associated perimeter shelf, an outboard wall, the perimeter shelf having an interior edge, which includes the steps of:

(a) constructing a footing form structure with a form member; an upper edge associated with said footing form structure;

(b) supporting said footing form structure on said shelf;

(c) adjusting said footing form structure such that said upper edge is generally level;

(d) pouring viscous concrete into a footing form volume defined by said form structure; the shelf, and the wall;

(e) creating an upper surface in said concrete poured into said footing form volume;

(f) leveling said upper surface of said concrete substantially flush with said upper edge of said footing form structure; and (g) allowing said concrete to cure to provide a concrete footing.

2. An in-ground swimming pool construction method in an excavated hole with an associated perimeter shelf and wall, which includes the steps of:

(a) constructing a footing form structure with a form member having an inboard vertical face, an outboard vertical face, a lower edge, and an upper edge;

(b) positioning said footing form member over the interior edge of the shelf;

(c) adjusting the vertical position of the footing form member such that the upper edge of the footing form member is generally level;

(d) pouring viscous concrete into a footing form volume defined by said form member outboard face, said shelf, and hole wall;

(e) creating an upper surface in the concrete poured into the footing form volume; and (f) levelling said upper surface of concrete substantially flush with upper edge of said footing form member; hence allowing the concrete to cure to provide a concrete footing.

3. An in-ground swimming pool construction method which includes steps of:

(a) excavating a swimming pool hole of desired surface and volume dimensions, said hole having an outboard, peripheral wall;

(b) excavating a working shelf with an interior edge in said wall;

(c) constructing a footing form structure with a form member having an inboard vertical face, an outboard vertical face, a lower edge, and an upper edge;

(d) positioning said footing form member over the interior edge of the shelf;

(e) adjusting the vertical position of the footing form member such that the upper edge of the footing form member is generally level;

(f) pouring viscous concrete into a footing form volume defined by said form member outboard face, said shelf, and said hole wall;

(g) creating an upper surface in the concrete poured into the footing form volume;

(h) levelling said upper surface of the concrete substantially flush with the upper edge of the footing form member;

(i) allowing the concrete to cure to provide a concrete footing;

(j) placing wall forms on said concrete footing and said form member upper edge;

(k) asembling said wall forms;

(l) filling the assembled wall forms with viscous concrete to form a concrete wall and allowing the concrete to cure;

(m) stripping the footing form structure and the wall forms; and (n) placing a swimming pool liner in said excavation over said concrete wall and footing.

* * * * *